United States Patent [19]

Tullman

[11] 4,414,907

[45] Nov. 15, 1983

[54] BUTTONHOLE WIDTH ADJUSTING MECHANISM

[75] Inventor: Edward J. Tullman, Union, N.J.

[73] Assignee: The Singer Company, Stamford, Conn.

[21] Appl. No.: 365,754

[22] Filed: Apr. 5, 1982

[51] Int. Cl.[3] ..... D05B 3/02; D05B 3/06

[52] U.S. Cl. ..... 112/158 B

[58] Field of Search ..... 112/158 R, 158 B

[56] References Cited

U.S. PATENT DOCUMENTS

| | | |
|---|---|---|
| 225,199 | 3/1880 | Smith . |
| 1,083,556 | 1/1914 | Ohlson . |
| 2,378,534 | 6/1945 | Beyer . |
| 2,828,705 | 4/1958 | Enos . |
| 2,966,869 | 1/1961 | Fischer . |
| 2,983,240 | 5/1961 | Engle . |
| 3,476,066 | 11/1969 | Szuba et al. . |
| 3,522,781 | 8/1970 | Baruffa . |
| 3,985,087 | 10/1976 | Herr et al. ..... 112/158 R |

*Primary Examiner*—Werner H. Schroeder
*Assistant Examiner*—Andrew M. Falik
*Attorney, Agent, or Firm*—Edward P. Schmidt; Robert E. Smith; Edward L. Bell

[57] ABSTRACT

A mechanism to facilitate selection of a standard size or shirt type buttonhole by interposing a link between the needle bar gate and driving arm and substantially parallel to the driving arm, with the connection between the driving arm and the link being movable to the selected positions based from the pivot point for the needle bar gate in order to obtain transfer of a proportion of the motion of the driving arm to the needle bar gate.

5 Claims, 6 Drawing Figures

BUTTONHOLE WIDTH ADJUSTING MECHANISM

BACKGROUND OF THE INVENTION

This invention is in the field of sewing machines; more particularly, this invention is concerned with a mechanism for simplifying the selection of discrete sizes of buttonholes.

In zig zag sewing machines for effecting a buttonhole, it is quite common to provide one control which may adjust the needle position, bight, and feed length and direction for each side and bar of the buttonhole by being manipulated to a selected one of three positions. Such a device is shown in U.S. Pat. No. 3,031,138, issued on May 8, 1962 to Bono.

It also is known that a sewing artisan may at times desire a standard type of buttonhole, or may require a narrow buttonhole which is less conspicuous. The former standard buttonhole is normally used in outer wear such as coats and, the more narrower buttonhole may be used in shirts in which it is desireable to keep the stitching rather inconspicuous. However, providing for a standard or shirt type buttonhole together with the use of a single dial to establish needle position, jogging width and material feed for each of the buttonhole sides presents an undue complication.

What is required is a mechanism which will allow selection of a standard or shirt type of buttonhole without affecting the operation of the dial which selects the side of the buttonhole to be implemented by a sewing machine.

SUMMARY OF THE INVENTION

The above requirement is obtained in a sewing machine in which in addition to the mechanism normally provided for obtaining zig zag motion of the needle bar of selected bight, there is provided a second mechanism which may be interposed between the needle bar gate and the first mechanism for passing only a selected portion of the motion of the first mechanism to the needle bar gate. In the usual sewing machine mechanism, a cam is provided which, through a cam follower, transfers the vibrations induced by the cam to one end of a pivoted paddle. In the invention, a selected amount of the motion of the pivoted paddle is taken off by a driving arm for transference to a point adjacent a sewing machine needle bar gate. The driving arm adjacent the sewing machine needle bar gate is hingedly connected to one end of a link, the other end of which is pivotally connected to the needle bar gate. Means are provided to selectively locate the hinged connection to the driving arm in discrete positions spaced from the pivot point for the needle bar gate. Thus, the oscillations of the driving arm influenced by the sewing machine cam may be selectively proportioned to provide a selected variation in the pattern implemented by the sewing needle of the sewing machine.

DESCRIPTION OF THE DRAWINGS

With the above and additional objects and advantages in mind as will hereinafter appear, the invention will be described with reference to the attached drawings in which:

Referring now to FIG. 1, there is shown a portion of a sewing machine 10 including a bed plate 12 from one end of which rises a standard 14 to support a bracket arm 16 overhanging the bed plate, the bracket arm terminating in a head end portion 18. Extending downwardly from the head end portion 18 towards the bed plate 12 is a presser bar 20 which terminates in a presser foot 22 affixed thereto by screw 21. Also extending from the head end portion 18 is a needle bar 24, which needle bar terminates in a sewing needle 25. A top cover 28 supports thereon a thread carrying spool 29 which supplies thread 30 to extend through guide 31, about pivot point 32, through the upper tension 34 to takeup lever 36, and from there to the sewing needle 25.

Figure 1:
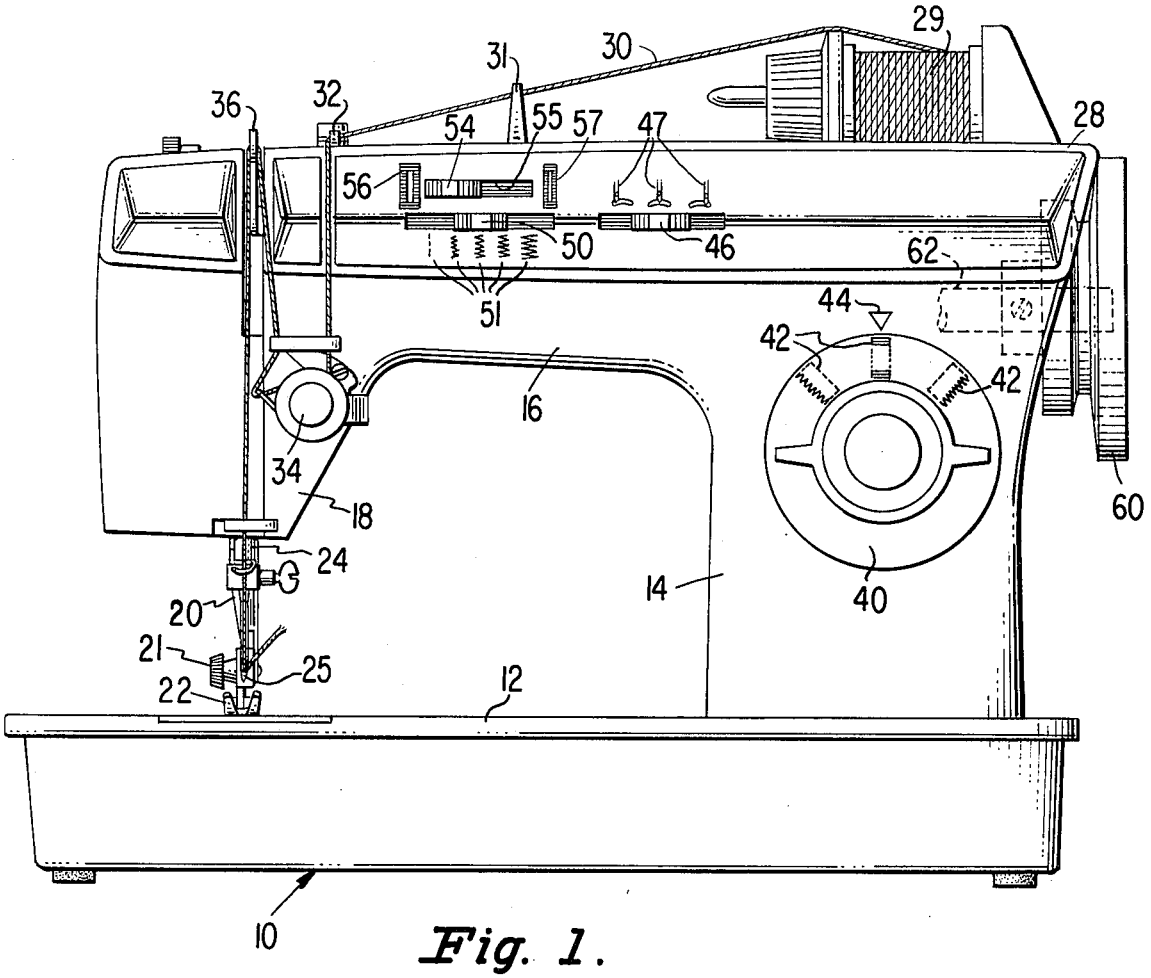
FIG. 1 is a front elevational view of a sewing machine in which the invention has been incorporated.

Supported in the standard 14 is a dial 40 which may be used to set the stitch length in any of a variety of ways well known in the sewing machine art. The dial 40 may also be used to establish needle position, zig zag width (bight) and direction and rate of material feed for a buttonhole in a manner similar to that disclosed in the aforementioned U.S. Pat. No. 3,033,138 of Bono. For this purpose, indicia 42 are provided which, when aligned with mark 44 on the standard 14 will arrange the needle position, bight and material feed as necessary to provide the indicated steps for, in this case, a four step buttonhole.

In the bracket arm 16 there is indicated a lever 46 which may be positioned according to the indicia 47 in order to obtain the indicated needle position for any specific purpose in normal sewing. There is also indicated a lever 50 which may be positioned according to the indicia 51 in order to obtain the bight indicated by the indicia. Supported above the lever 50 is a second lever 54 which may be shifted to the left side of the slot 55 to implement a standard size buttonhole as indicated by indicium 56, or to the right side to implement a shirt type buttonhole indicated by indicium 57.

Figure 2:
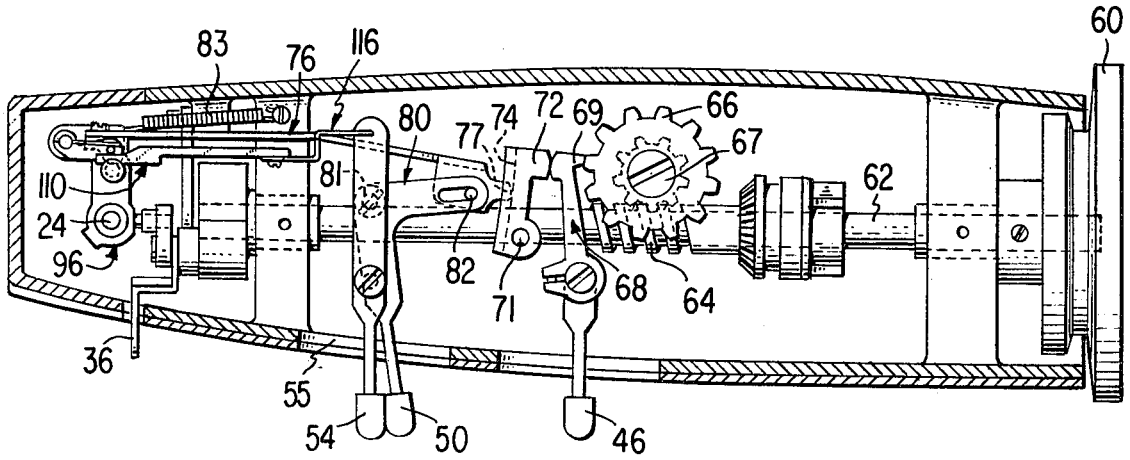
FIG. 2 is a top plan view of the sewing machine with the top cover removed to show details of the invention.

Referring to FIG. 2 there is shown a top plan view of the sewing machine shown in FIG. 1 with the top cover 28 thereof removed. Thus, there is shown in the right-hand extreme a handwheel 60 affixed to the end of an arm shaft 62 which may be rotated in the usual fashion by an electric motor (not shown). A worm 64 on the arm shaft 62 drives a worm gear (not shown) so as to rotate a cam 66 affixed thereto by screw 67. A cam follower lever 68 is pivotally carried on an eccentric bushing actuated by lever 46, and is fashioned with a cam follower tip 69 which tracks the cam 66. A paddle 70 is pivoted as at 71 and is fashioned with an enlarged portion at the extremity 72 opposite the pivot, and this extremity is in engagement with an enlarged portion of the cam follower lever 68 behind the tip 69 thereof. The paddle 70 is fashioned with a groove 74 (see also FIG. 3), into which groove there extends the tip 77 of a driving arm 76. A bell crank 80, one arm of which is the lever 50, is pivoted on the sewing machine frame by a shoulder screw 81 and is fashioned in the other end with a pin 82 which extends through a slot 78 in the driving arm 76 to move the tip 77 thereof in the groove 74 of the paddle 70. When the tip 77 is located adjacent the pivot 71 of the paddle 70, no motion from the cam 66 is passed on to the driving arm 76. If the tip 77 of the driving arm 76 is located midway the groove 74 in the driving arm 76, or is located behind the extremity 72 thereof, one half, or all, respectively, of the motion from the cam 66 is transferred to the driving arm.

Figure 3:
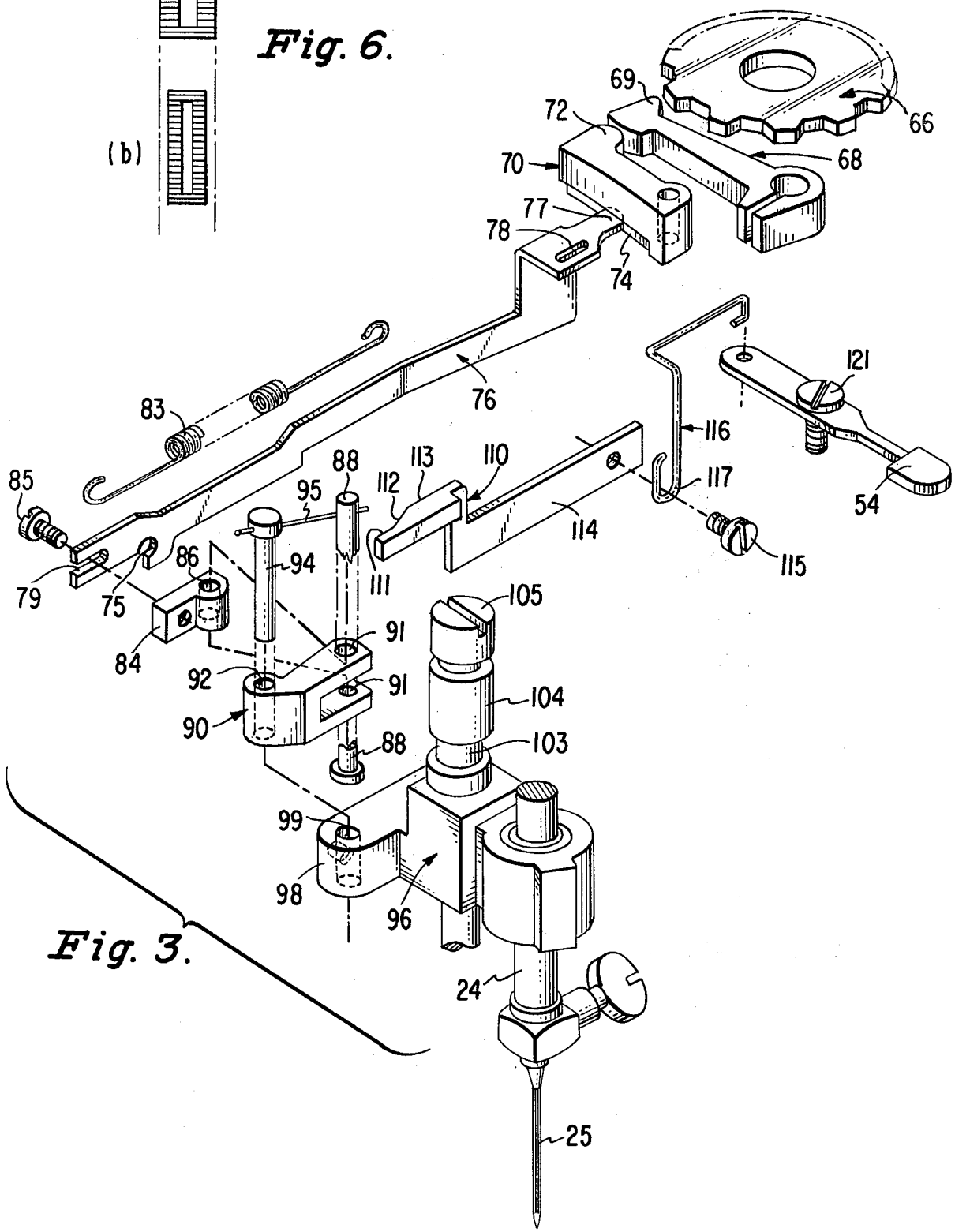
FIG. 3 is an exploded isometric view of the invention.

Referring particularly to FIG. 3, the opposite end of driving arm 76 is formed with an open slot 79 through which a screw 85 extends to retain member 84 firmly attached thereto in a selected position. A spring 83 extends between notch 75 of driving arm 76 and some fixed point on the sewing machine frame so as to maintain the tip 77 of the driving arm in engagement with the groove 74 in the paddle 70. The member 84 is fashioned with an enlarged end having a bore 86 therethrough. The enlarged end of member 84 fits within the bifrucated end of idler link 90, which bifrucated end has aligned bores 91 therethrough which are coextensive with bore 86 in the member 84, the bores receiving a hinge connector 88. The hinge connector 88 extends through the bores 86 and 91, and stands above the link 90 for a purpose which will be explained below. The opposite end of link 90 from the bores 91 is also bored 92 to receive a headed pivot pin 94 which extends through the link into a bore 99 in an ear 98 of needle bar gate 96. A pin 104 having a slot 105 in the head thereof is supported in the head end portion 18 of the sewing machine frame and extends through an aperture (not shown) in the needle bar gate 96 to support the needle bar gate in oscillations effecting zig zag motion of the sewing needle 25 retained in the end of the needle bar 24. Link 90 extends substantially parallel to driving arm 76.

Figure 4:
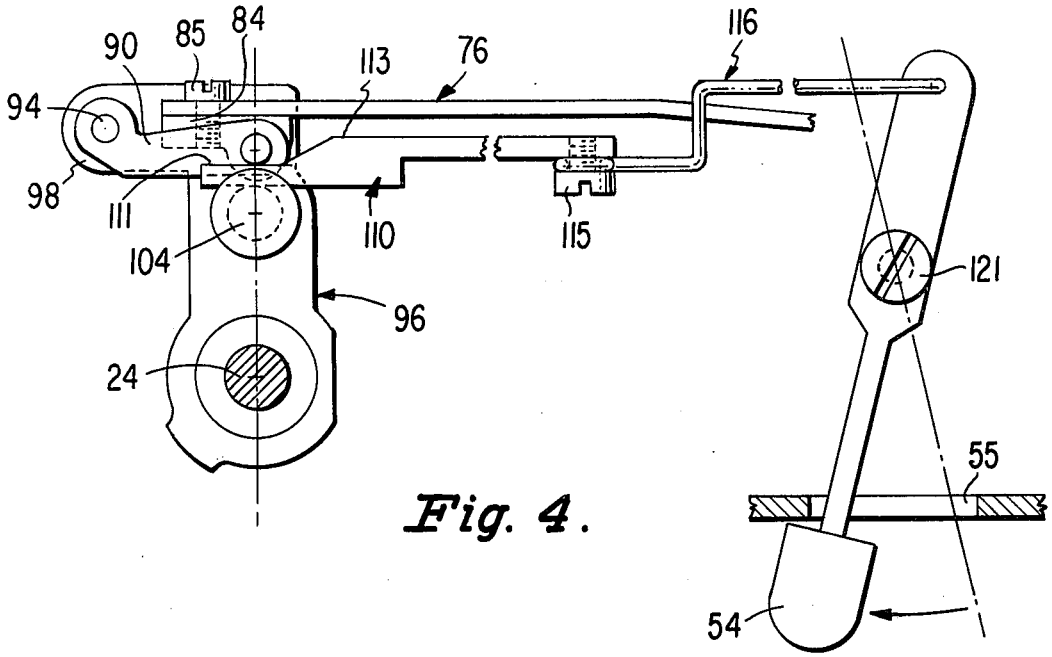
FIG. 4 is a top plan view of the mechanism of the invention in one operating position.
Figure 5:
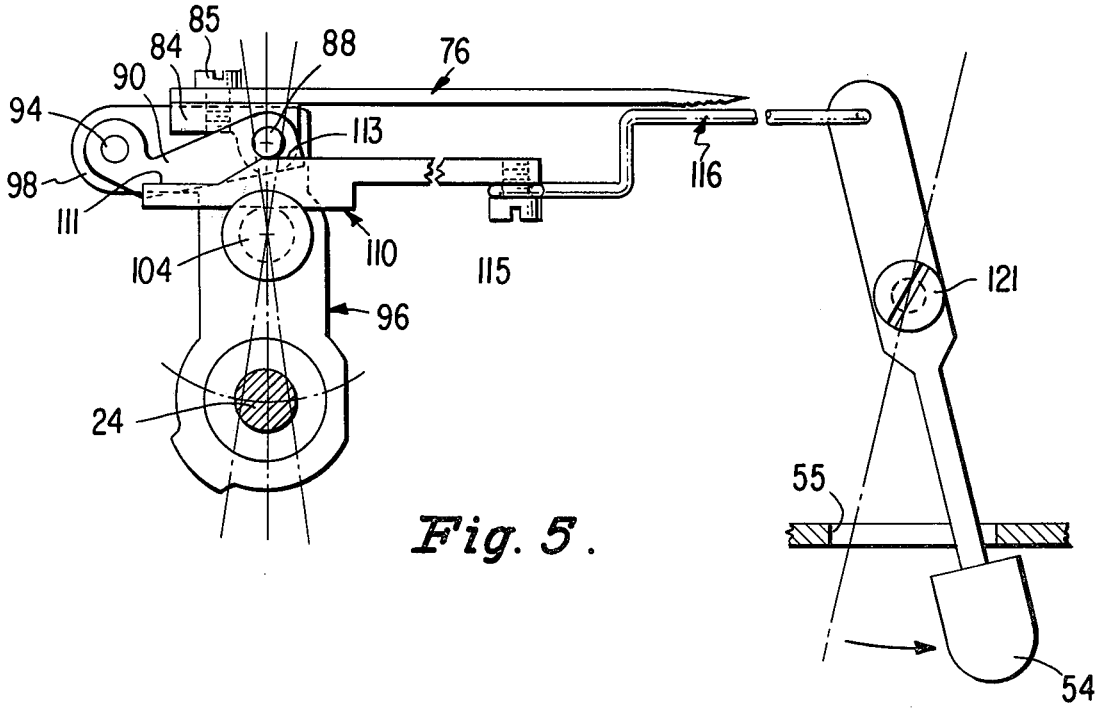
FIG. 5 is a top plan view of the invention in another operating position to obtain a proportion of the motion obtainable in FIG. 4; and, FIG. 6 is a diagram comprising a standard buttonhole in 6*a* to a shirt type buttonhole depicted in 6*b*.

An interposer 110 is fashioned with an end 111 which sits in a groove 103 in the pin 104 and against the hinge connector 88. The head of the headed pivot pin 94 retains an end of a wire spring 95 which extends out to bear on the hinge connector 88 to insure that the hinge connector remains in contact with the end 111 of the interposer 110. The end 111 of the interposer 100 is further fashioned with a ramp 112 which guides the hinge connector 88 away from the pin 104 when the interposer 110 is moved to the left as shown in FIGS. 4 and 5, so as to urge the hinge connector to a new level 113 of the interposer in which the hinge connector is moved further away from the pin 104. This motion of the interposer 110 is influenced by means of an extension 114 having a threaded connection therein for screw 115 which extends through an adjusting U form 117 in the end of wire form 116, the other end of which is connected to the lever 54 pivoted to the sewing machine frame by shoulder screw 121.

Thus as is shown in FIG. 4, with the lever 54 pivoted in a clockwise direction, the interposer 110 is in a position with its end 111 situated between the hinge connector 88 and the groove 103 in the eccentric pin 104. Thus, the motion imparted to the driving arm 76 by the cam 66 and transferred to the hinge connector 88 will have the most effect since the hinge connector is located closest to the center of the pin 104 on which the needle bar gate 96 pivots. If, on the other hand, the lever 54 were to be rotated counterclockwise and level 113 of the interposer 110 is interposed between the hinge connector 88 and the groove 103 of the eccentric pin 104, the hinge connector is located at a greater distance from the pin 104 about which the needle bar gate 96 pivots and, accordingly, the driving arm 76 influences less pivotal motion of the needle bar gate 96.

Figure 6:
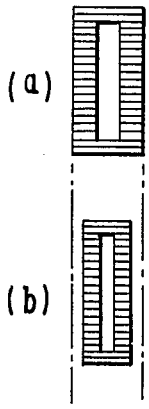

Thus, the dial 40 may be used to establish the proper needle position and bight for a standard size buttonhole as shown in FIG. 6*a*. By a proper initial design of the interposer 110, specifically the relationship between the end 111 and the level 113 thereof, the effect of the motion of the driving arm 76 may be reduced so that in place of the standard buttonhole shown in FIG. 6*a*, a reduced size shirt type buttonhole shown in FIG. 6*b* may be produced by a manipulation of lever 54. As many levels may be designed into the interposer 110 as there are required buttonhole sizes.

Numerous alterations of the structure herein disclosed will suggest themselves to those skilled in the art. However, it is to be understood that the present disclosure relates to a preferred embodiment of the invention which is for purposes of illustration only, and not to be construed as a limitation of the invention. All such modificiations which do not depart from the spirit and scope of the invention are intended to be included within the appended claims.

I claim:

1. A sewing machine having a needle bar gate arranged for pivotal vibratory motion along an axis;

means for storing bight information;

means for sensing said stored bight information;

means for imparting pivotal vibratory motion to said needle bar gate in relation to said bight information sensed by said sensing means;

means between said imparting means and said sensing means for selectively attenuating the motion imparted to said imparting means by said sensing means; and, control means interposed between said needle bar gate and said imparting means for selectively effecting specific proportions of said imparted pivotal vibratory motion.

2. The combination of claim 1 wherein said control means includes a link member pivotally associated with said needle bar gate and with said imparting member at a point a selected distance away from said axis of said pivotal vibratory motion of said needle bar gate.

3. The combination of claim 1 wherein said control means comprises an idler link a first end of which is pivotally attached to said imparting means and a second end of which is pivotally attached to said needle bar gate so that said first end is closer to said axis of said pivotal vibratory motion of said needle bar gate than is said second end of said idler link.

4. The combination of claim 3 wherein said axis for pivotal vibratory motion is implemented by a pivot pin, and said first end of said idler link is pivotally attached to said imparting means by a hinge connector, and wherein said control means further includes means for maintaining said first end of said idler link at one of selected distances from said axis of said needle bar for obtaining a selected proportion of pivotal vibratory motion of said imparting means, said maintaining means including an interposer having at least two different thicknesses separated by a ramp inserted between said pivot pin and said hinge connector.

5. The combination of claim 4 wherein said idler link is substantially parallel to said imparting means.

* * * * *